US005100065A

United States Patent [19]

Evans et al.

[11] Patent Number: 5,100,065

[45] Date of Patent: Mar. 31, 1992

[54] METHOD OF COMMINUTION OF HYDRIDED METALS

[75] Inventors: Steven C. Evans; Victor L. Jacobson; Steven D. Richards, all of Ogden, Utah

[73] Assignee: Westinghouse Electric Corp., Pittsburgh, Pa.

[21] Appl. No.: 489,136

[22] Filed: Mar. 5, 1990

Related U.S. Application Data

[63] Continuation-in-part of Ser. No. 422,334, Jun. 19, 1990, Pat. No. 4,934,610.

[51] Int. Cl.[5] ..... B22F 1/00; B02C 23/18

[52] U.S. Cl. ..... 241/16; 241/18

[58] Field of Search ..... 241/5, 26, 27, 15, 16, 241/18, DIG. 14

[56] References Cited

U.S. PATENT DOCUMENTS 4,369,078 1/1983 Allard ..... 241/18 X 4,579,587 4/1986 Grant et al. ..... 241/15 X

*Primary Examiner*—Timothy V. Eley

*Attorney, Agent, or Firm*—Z. L. Dermer

[57] ABSTRACT

A reactive metal such as zirconium, hafnium, and titanium is subjected to comminution in a closed chamber containing a non-reactive gas modified by the addition of an amount of a vaporized liquid hydrocarbon.

6 Claims, No Drawings

METHOD OF COMMINUTION OF HYDRIDED METALS

This is a continuation-in-part of Ser. No. 07/422,334, filed June 19, 1990, now U.S. Pat. No. 4,934,610.

BACKGROUND OF THE INVENTION

1. Field of the Invention:

The invention is concerned with the comminution of hydrided reactive metals, such as zirconium, hafnium and titanium, in a non-reactive atmosphere.

2. Description of the Prior Art:

Comminution of hydrided reactive metals, e.g. zirconium, is ordinarily carried out in a chamber closed to the atmosphere and containing a non-reactive gas, such as argon or helium. The chamber is usually what is known as a "gloved chamber" wherein flexible impervious gloves extend through a wall of the atmospherically sealed chamber, being themselves sealed to such wall against the entry of the outside air into the sealed chamber. A workman outside the chamber can place his hands in the gloves and manipulate items within the chamber without breaking the seals.

In accordance with conventional practice, surface energy of fresh surfaces of the comminuted metal within the chamber is passivated by absorption of small amounts of oxygen and nitrogen, but the presence of even small quantities of oxygen and nitrogen in the comminuted metal is undesirable.

SUMMARY OF THE INVENTION

In copending application Ser. No. 07/422,334 filed Oct. 16, 1989 by the present coinventor Steven C. Evans as sole inventor, as to which the present application constitutes a continuation-in-part, both applications being owned in common by Westinghouse Electric Corporation, it is disclosed that the addition of a small amount of water vapor to the non-reactive gas in the sealed comminution chamber will greatly reduce the tendency for take-up of oxygen and nitrogen by the fresh surfaces of the reactive metal particles.

In accordance with the present joint invention, it has been found that the addition of a small amount of a vaporized liquid hydrocarbon that is volatile at ambient temperature, such as produced by the evaporation of a liquid hydrocarbon having an OH radical bonded to an organic group, typically an alcohol, to the non-reactive atmosphere in the sealed comminution chamber will accomplish a similar result as is effected by the addition of water vapor in accordance with the aforementioned copending application, but to a considerably greater extent. Thus, the undesirable tendency of the fresh surfaces of the comminuted metal take-up oxygen and nitrogen is lowered by several times over that accomplished by water vapor.

It should be noted that the non-reactive gas in customary practice prior to the invention has contained no discernable hydrocarbon.

A presently favored way of adding the vaporized liquid hydrocarbon to the non-reactive gas in the sealed comminution chamber is by placing an alcohol-saturated, absorbent carrier, usually a fabric, within the chamber, with its surfaces exposed to the non-reactive gas within the chamber, although other ways may be employed, e.g. by placing a wick within the chamber of size and degree of wetness attuned to the amount of the vaporized liquid hydrocarbon found effective for accomplishing the purpose in any particular instance, typically less than one percent by volume of the amount of non-reactive gas within the chamber. In general, it can be said that it is only necessary to add a sufficient amount of the vaporized liquid hydrocarbon to the atmosphere within the chamber to lower the surface energy of the particles of comminuted metal to a point at which the surfaces of such particles of metal are passivated against the pick-up of oxygen and nitrogen.

DETAILED DESCRIPTION OF THE PREFERRED PROCEDURE

As in the instance of water vapor, the best mode presently contemplated for carrying out the invention in commerical practice (utilizing a comminution chamber whose interior volume is typically about 200 cubic feet) is to place on the floor of the chamber an open stainless steel vessel of about 30 cubic inches capacity containing a cotton wick saturated with an alcohol, such as ethanol, and having a surface area of about one square foot exposed to the non-reactive atmosphere within the sealed chamber.

Because of high vapor pressure, the vaporized liquid hydrocarbon in the form of a polarized hydrocarbon gas dissipates quickly in the inert gas atmosphere.

Although alcohols are preferred as the source of the vaporized liquid hydrocarbon employed pursuant to the invention, other organic liquids having an OH radical bonded to an organic group and being volatile at atmospheric temperature may be employed.

In instances of the present invention, any residual of the passivating hydrocarbon gas on the surfaces of the comminuted metal is removed by vacuum processing of the comminuted metal after removal from the comminution chamber, as by introduction of such comminuted metal into a vacuum chamber and exposure of the metal to a vacuum of less than one millimeter of mercury shown by a standard vacuum gauge.

Carrying out a comparative test on the basis of this best mode and using identical ingots of zirconium metal (preferably zircaloy, an alloy, containing about 98.5% zirconium, about 1.5% tin, and small amounts of other metals, such as iron, chromium, and nickel) and identical comminuting procedures within the comminution chamber, in one instance on the basis of only the usual non-reactive gas (argon) within the chamber in accordance with conventional practice and in a second instance on the basis of the addition of ethanol as the source of the vaporized liquid hydrocarbon to the extent of much less than one percent by volume of the non-reactive gas within the chamber, analysis of the comminuted metal particles generated by these respective procedures showed that those in the second instance, wherein comminution was carried out in the presence of the hydrocarbon gas addition, the take-up of nitrogen was reduced by 60 parts per million and of oxygen was reduced by 400 parts per million.

This showed that practice of the invention lowers the usual oxygen pick-up by the fresh surfaces of the comminuted metal by 66% and the usual nitrogen pick-up by 90%.

Whereas this invention is here illustrated and described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

We claim as our invention:

1. A process of comminuting a hydrided reactive metal within a sealed chamber filled with a non-reactive gas, comprising adding to said non-reactive gas within the chamber an amount of a vaporized liquid hydrocarbon that is volatile at ambient temperature and is effective to passivate fresh surfaces of particles of said metal against pick-up of oxygen and/or nitrogen from said non-reactive atmosphere within the chamber; and carrying out comminution of said reactive metal within the so-modified non-reactive atmosphere within said chamber.

2. A process according to claim 1, wherein the liquid hydrocarbon has an OH radical bonded to an organic group.

3. A process according to claim 2, wherein the liquid hydrocarbon is an alcohol.

4. A process according to claim 1, wherein the vaporized liquid hydrocarbon is added to the non-reactive gas within the chamber by placing within said chamber an absorbent carrier carrying said liquid hydrocarbon and having surfaces exposed to said non-reactive gas.

5. A process according to claim 4, wherein the absorbent carrier is fabric.

6. A process according to claim 4, wherein the carrier is a wick having an exposed surface area of about one square foot.

* * * * *